US011180234B2

(12) United States Patent
Nakayama

(10) Patent No.: US 11,180,234 B2
(45) Date of Patent: Nov. 23, 2021

(54) OUTBOARD MOTOR

(71) Applicant: YAMAHA HATSUDOKI KABUSHIKI KAISHA, Iwata (JP)

(72) Inventor: Koichi Nakayama, Iwata (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 40 days.

(21) Appl. No.: 16/585,865

(22) Filed: Sep. 27, 2019

(65) Prior Publication Data

US 2020/0198746 A1 Jun. 25, 2020

(30) Foreign Application Priority Data

Dec. 20, 2018 (JP) ..... JP2018-237986

(51) Int. Cl.
*B63H 20/00* (2006.01)
*F02M 35/10* (2006.01)
*B63H 20/32* (2006.01)

(52) U.S. Cl.
CPC ..... *B63H 20/001* (2013.01); *F02M 35/10026* (2013.01); *F02M 35/10144* (2013.01); *B63H 2020/326* (2013.01)

(58) Field of Classification Search
CPC ..... F02M 35/167; F02M 35/10026; F02M 35/10052; F02M 35/10144; F02M 35/10321; F02M 35/10354; F02B 61/045; F02B 75/22; B63H 2020/326; F16L 17/06; F16L 17/067; F16L 17/073; F16L 23/16; F16L 23/162; F16L 23/22
USPC ..... 123/184.31, 184.34, 184.35, 184.36
See application file for complete search history.

(56) References Cited

U.S. PATENT DOCUMENTS 1,178,714 A * 4/1916 Griffin ..... F16L 23/16 285/331
4,895,112 A * 1/1990 Rutschmann ..... F02M 35/1165 123/184.31
5,778,847 A * 7/1998 Takahashi ..... F01M 1/02 123/195 P
8,366,501 B2 * 2/2013 Kazuta ..... B63H 21/32 440/89 H
2002/0173208 A1 * 11/2002 Yonezawa ..... F02B 61/045 440/88 J
2005/0061266 A1 * 3/2005 Kapala ..... F02M 35/10242 123/41.28

(Continued)

FOREIGN PATENT DOCUMENTS

DE 482387 C * 9/1929
DE 875108 C * 4/1953
DE 102004039132 A1 * 3/2006 ..... B29C 45/14311

(Continued)

*Primary Examiner* — Michael A Kessler
(74) *Attorney, Agent, or Firm* — Global IP Counselors, LLP

(57) ABSTRACT

An engine includes a crankshaft. A driveshaft is connected to the crankshaft, and extends in an up-and-down direction of an outboard motor. A propeller shaft is connected to the driveshaft, and extends in a back-and-forth direction of the outboard motor. An intake pipe is connected to the engine. The intake pipe includes a first pipe portion and a second pipe portion that are provided separately from each other. A seal member is disposed between the first and second pipe portions, and couples the first and second pipe portions therethrough.

20 Claims, 13 Drawing Sheets

(56) References Cited

U.S. PATENT DOCUMENTS

2007/0024007 A1* 2/2007 Putch ..... F16L 17/06
277/314

FOREIGN PATENT DOCUMENTS

| | | | | |
|---|---|---|---|---|
| DE | 202014103768 | U1 | * | 8/2014 |
| FR | 411551 | A | * | 6/1910 |
| FR | 1139128 | A | * | 6/1957 |
| FR | 1536752 | A | * | 8/1968 |
| JP | H07-77116 | A | | 3/1995 |

* cited by examiner

OUTBOARD MOTOR

BACKGROUND

Technical Field

The present invention generally relates to an outboard motor.

Background Information

An intake pipe is connected to an engine of an outboard motor. The intake pipe includes first and second pipe portions provided separately from each other. The first and second pipe portions are connected to each other. A seal member such as an O-ring is disposed between the first and second pipe portions. The first and second pipe portions are provided with at least one pair of bosses, through which at least one fastening member (e.g., bolt) is inserted. The first and second pipe portions are fixed to each other by the at least one fastening member, whereby the seal member is interposed between the first and second pipe portions. Consequently, the first and second pipe portions are sealed through the seal member.

For example, Japan Laid-open Patent Application Publication No. 1-107-77116 describes an engine in which an intake manifold is connected to a cylinder head-side intake pipe. An O-ring is disposed between the intake pipe and the intake manifold. The intake pipe and the intake manifold are provided with a plurality of pairs of bosses for fixation, and are fastened to each other by a plurality of bolts inserted through the plurality of pairs of bosses, respectively. Accordingly, the intake pipe and the intake manifold are sealed through the O-ring.

SUMMARY

In the aforementioned outboard motor; the first and second pipe portions are provided with the at least one pair of bosses, through which the at least one fastening member is inserted. Because of this configuration, an intake pathway, produced in the interior of the first and second pipe portions, is inevitably narrowed by the at least one pair of bosses. As a result, it is concerned that intake-side pressure loss occurs and results in degradation in output of the outboard motor.

One object of the present disclosure is to inhibit pressure loss in an intake pipe of an outboard motor.

An outboard motor according to an aspect of the present disclosure includes an engine, a driveshaft, a propeller shaft, an intake pipe and a seal member. The engine includes a crankshaft. The driveshaft is connected to the crankshaft, and extends in an up-and-down direction of the outboard motor. The propeller shaft is connected to the driveshaft, and extends in a back-and-forth direction of the outboard motor. The intake pipe is connected to the engine. The intake pipe includes a first pipe portion and a second pipe portion that are provided separately from each other. The seal member is disposed between the first and second pipe portions, and couples the first and second pipe portions therethrough.

In the outboard motor according to the present aspect, the intake pipe has the structure that the first and second pipe portions are coupled to each other through the seal member. Because of this configuration, the first and second pipe portions can be coupled to each other without using a fastening member such as a bolt. Accordingly, it is possible to omit installation of a structure such as a boss through which the fastening member is inserted. Hence, pressure loss can be inhibited in the intake pipe.

DETAILED DESCRIPTION OF EMBODIMENTS

Figure 1:
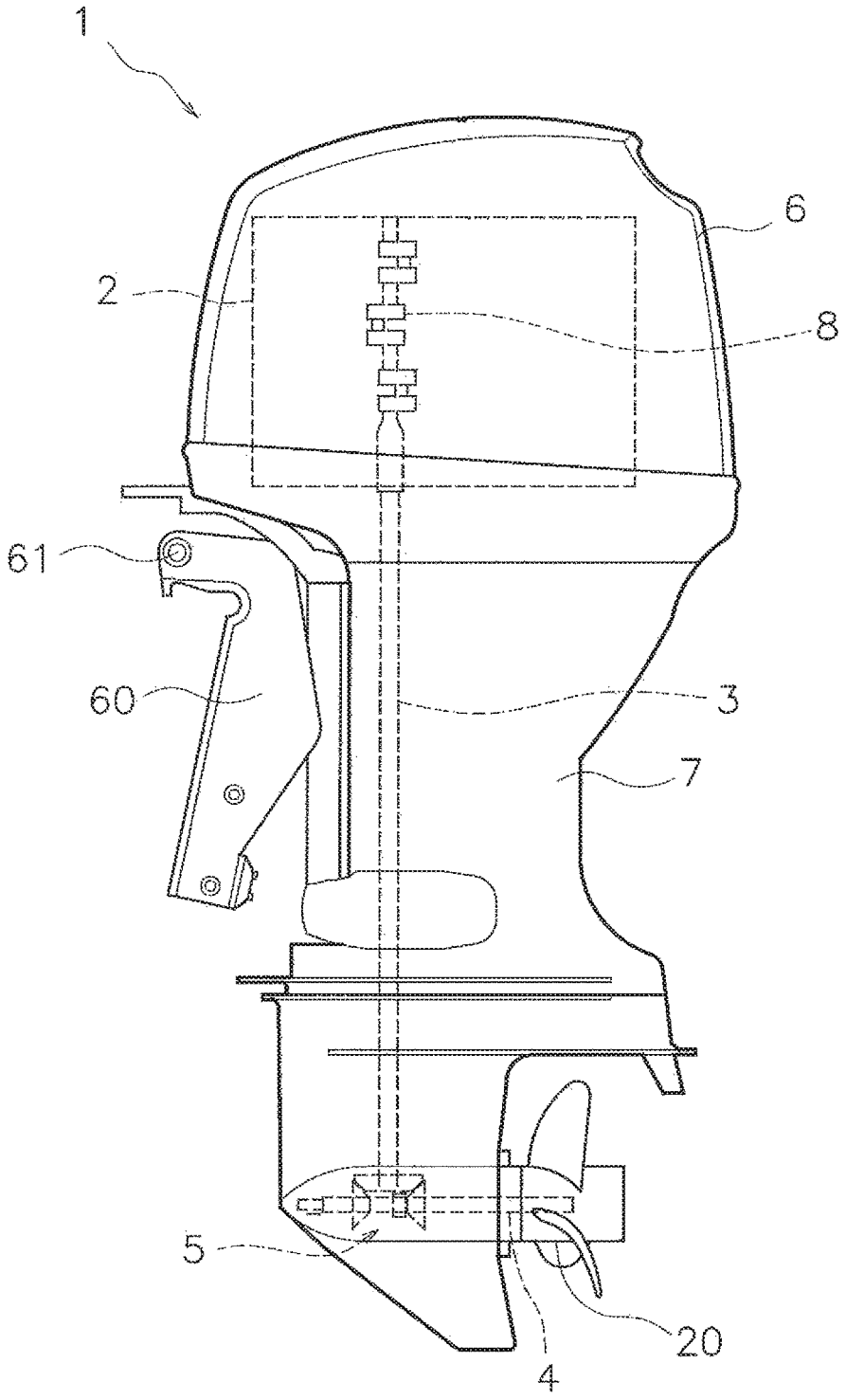
FIG. 1 is a side elevational view of an outboard motor according to an embodiment.

An embodiment will be hereinafter explained with reference to drawings. FIG. 1 is a side view of an outboard motor 1 according to the embodiment. As shown in FIG. 1, the outboard motor 1 includes an engine 2, a driveshaft 3, a propeller shaft 4, a shift mechanism 5, an engine cowl 6 and a housing 7. It should be noted that in the following explanation, front, rear, left, right, up and down directions are defined as meaning the front, rear, left, right, up and down directions of the outboard motor 1, respectively.

The engine 2 generates a thrust for propelling a watercraft. The engine 2 is disposed inside the engine cowl 6. The engine 2 includes a crankshaft 8. The crankshaft 8 extends in a vertical direction. The driveshaft 3 is connected to the crankshaft 8. The driveshaft 3 extends in an up-and-down direction. The propeller shaft 4 extends in a direction intersecting with the driveshaft 3. The propeller shaft 4 extends in a back-and-forth direction. The propeller shaft 4 is connected to the driveshaft 3 through the shift mechanism 5. A propeller 20 is connected to the propeller shaft 4.

The housing 7 is disposed below the engine cowl 6. The driveshaft 3 is disposed inside an upper portion of the housing 7. The propeller shall 4 and the shift mechanism 5 are disposed inside a lower portion of the housing 7. The shift mechanism 5 switches the rotational direction of power to be transmitted from the driveshaft 3 to the propeller shaft 4. The shift mechanism 5 includes, for instance, a plurality of gears and a clutch that changes meshing of the gears.

The outboard motor 1 includes a bracket 60. The outboard motor 1 is attached to a vessel body of the watercraft through the bracket 60. The bracket 60 includes a trim and tilt shaft 61. The trim and tilt shaft 61 extends in a right-and-left direction of the outboard motor 1. The outboard motor 1 is supported by the bracket 60, while being rotatable about the trim and tilt shaft 61.

Figure 2:
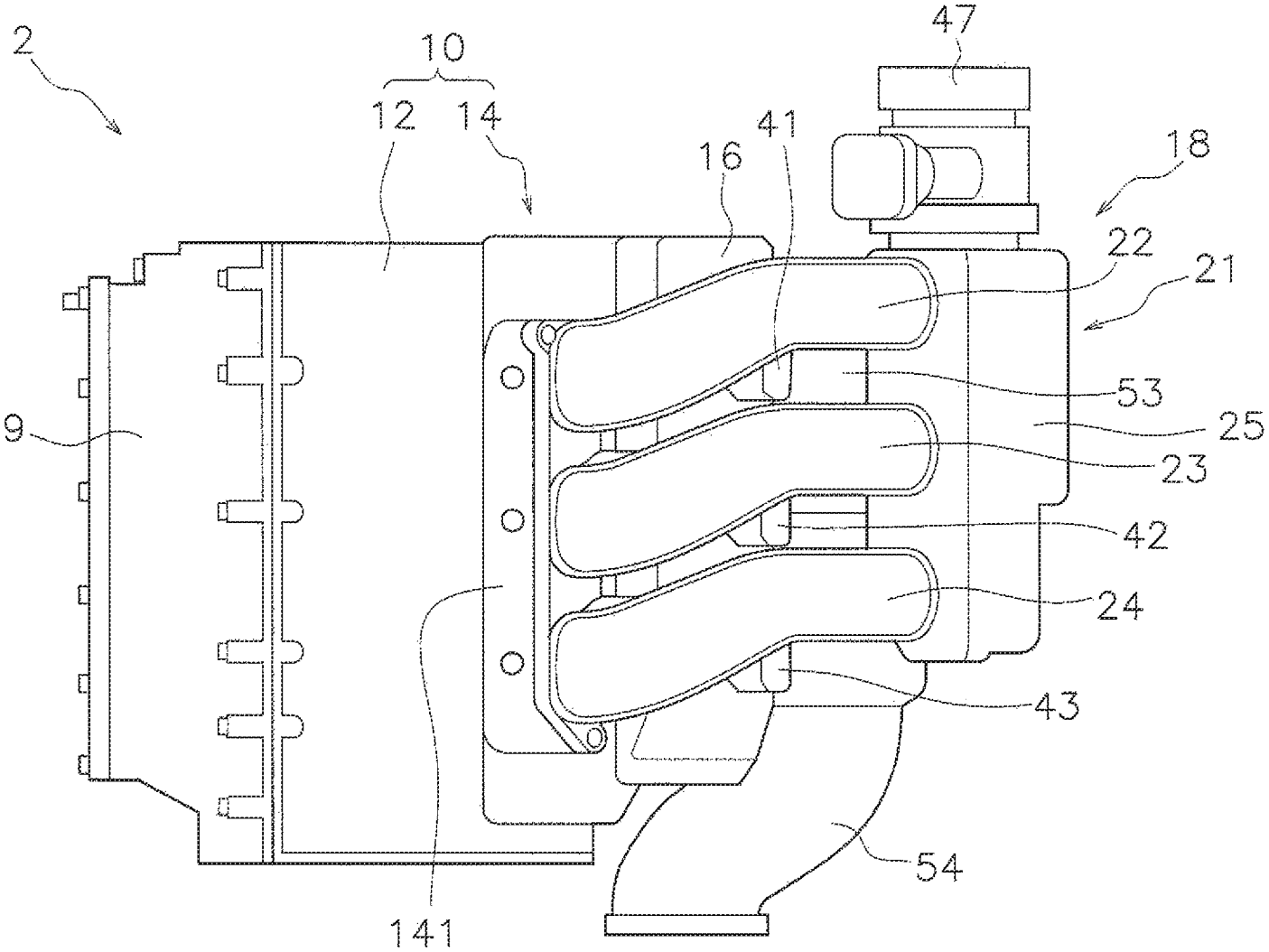
FIG. 2 is a left side elevational view of an engine for the outboard motor illustrated in FIG. 1.
Figure 3:
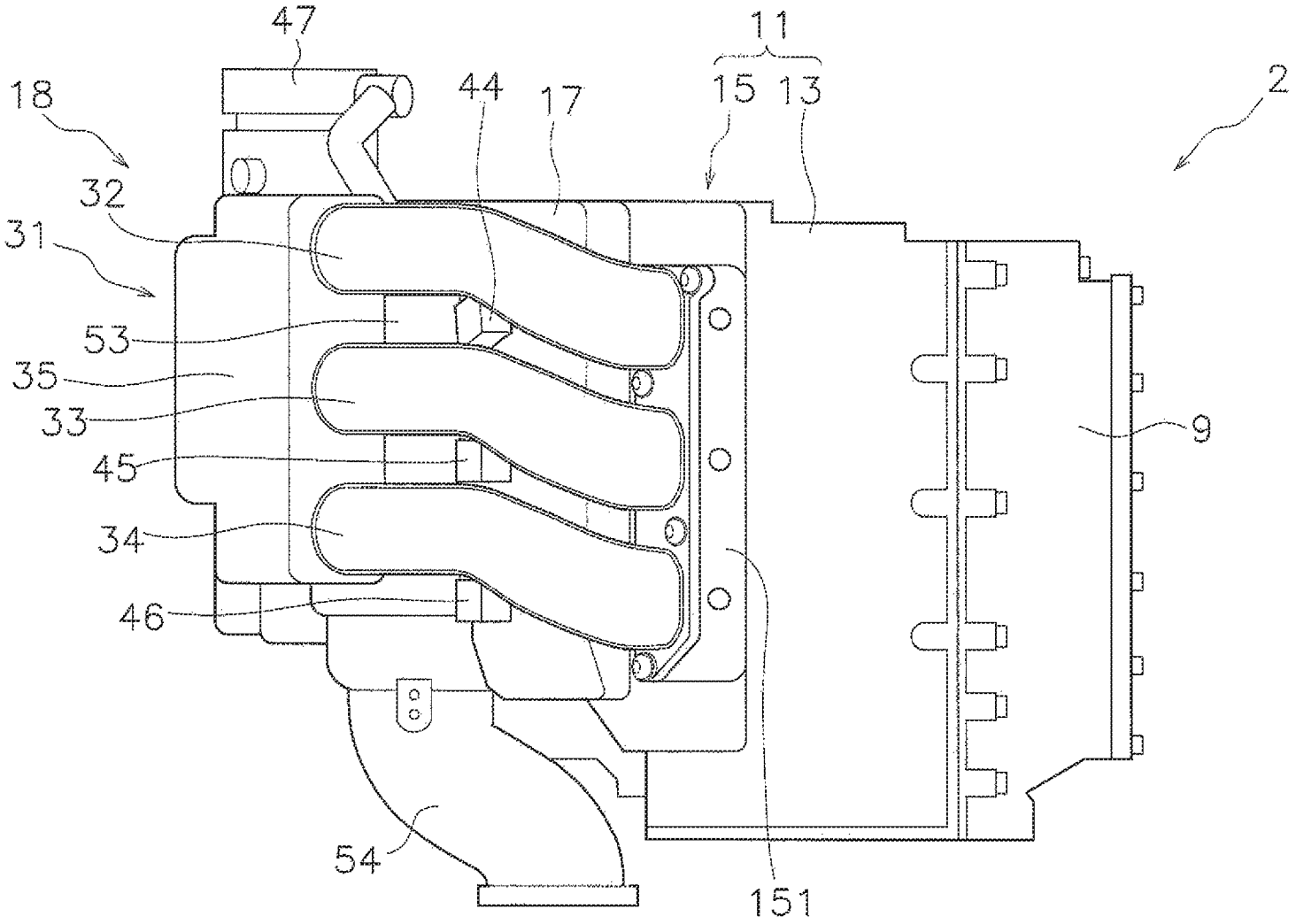
FIG. 3 is a right side elevational view of the engine illustrated in FIG. 2.
Figure 4:
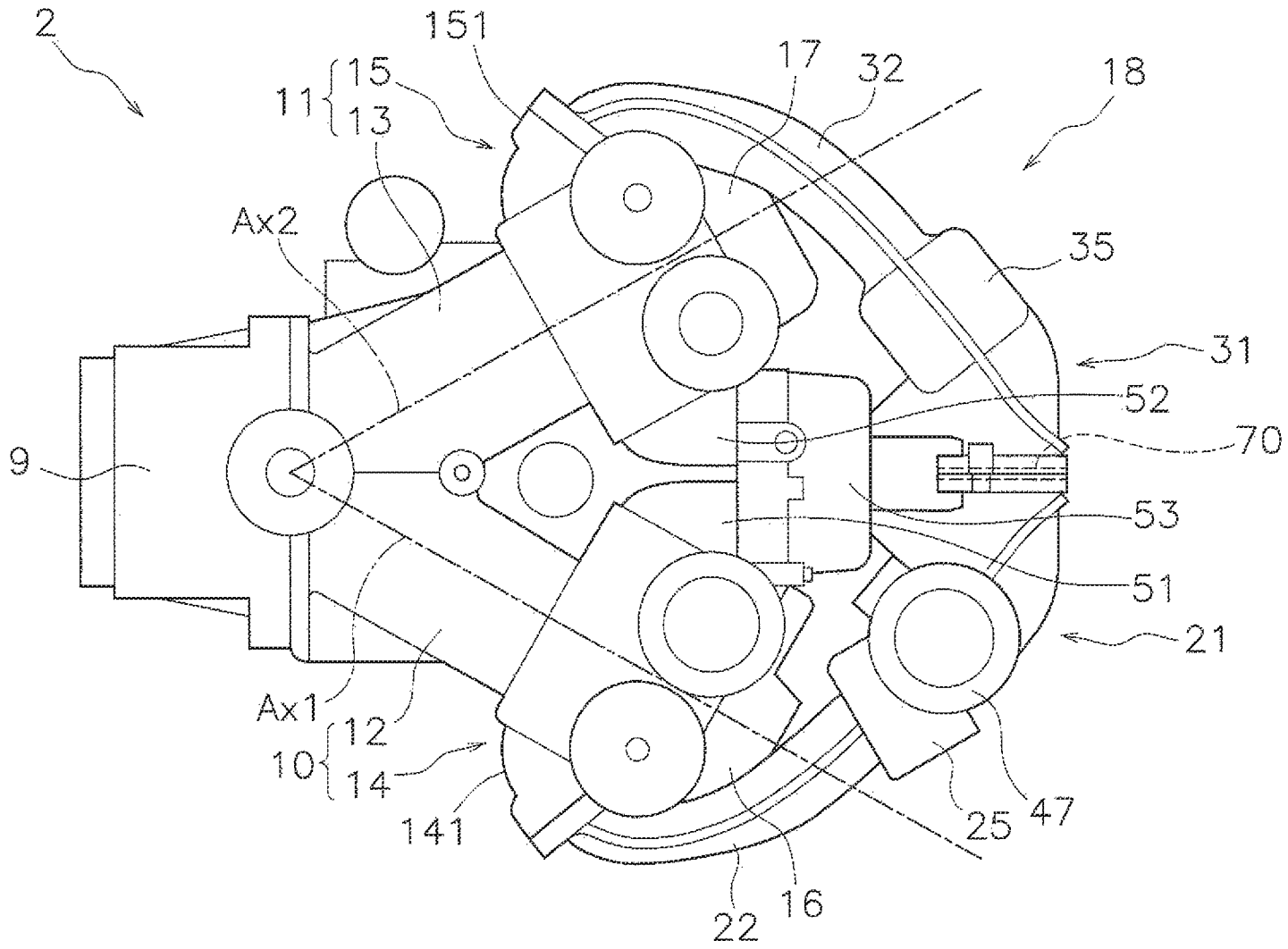
FIG. 4 is a top view of the engine illustrated in FIGS. 2 and 3.
Figure 5:
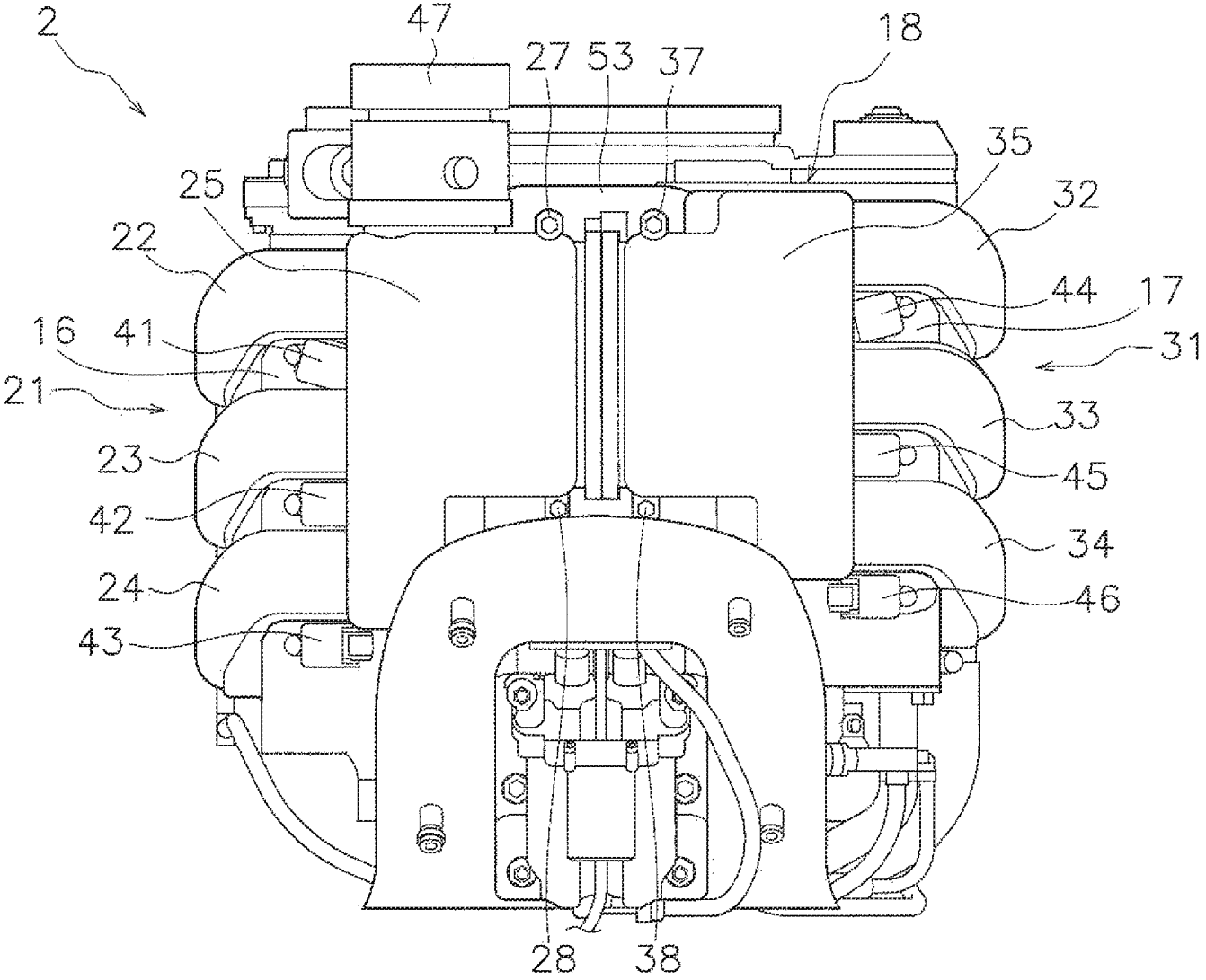
FIG. 5 is a rear view of the engine illustrated in FIGS. 2 to 4.

FIG. 2 is a left side elevational view of the engine 2. FIG. 3 is a right side elevational view of the engine 2 illustrated in FIG. 2. FIG. 4 is a top view of the engine 2 illustrated in FIGS. 2 and 3. FIG. 5 is a rear view of the engine 2 illustrated in FIGS. 2 to 4. As shown in FIGS. 2 to 4, the engine 2 includes a crankcase 9, a first cylinder portion 10, a second cylinder portion 11, a first head cover 16 and a second head cover 17. The crankcase 9 accommodates at least part of the crankshaft 8 described above.

The first and second cylinder portions 10 and 11 are disposed behind the crankcase 9. The first and second cylinder portions 10 and 11 are disposed in left and right alignment. The first and second cylinder portions 10 and 11 are disposed to tilt with respect to the back-and-forth direction such that an interval therebetween is widened backward. The first cylinder portion 10 includes a cylinder axis Ax1 extending backward and leftward. The second cylinder portion 11 includes a cylinder axis Ax2 extending backward and rightward. The engine 2 is a so-called V engine.

The first cylinder portion 10 includes a first cylinder body 12 and a first cylinder head 14. The second cylinder portion 11 includes a second cylinder body 13 and a second cylinder head 15. The first and second cylinder bodies 12 and 13 are disposed behind the crankcase 9. The first and second cylinder bodies 12 and 13 are disposed in left and right alignment. The first and second cylinder bodies 12 and 13 are connected to the crankcase 9.

The first cylinder head 14 is disposed behind the first cylinder body 12. The second cylinder head 15 is disposed behind the second cylinder body 13. The first cylinder head 14 is connected to the first cylinder body 12. The second cylinder head 15 is connected to the second cylinder body 13. The first and second cylinder heads 14 and 15 are disposed in left and right alignment. The first and second cylinder heads 14 and 15 are disposed to tilt with respect to the back-and-forth direction such that an interval therebetween is widened backward.

It should be noted that the first and second cylinder bodies 12 and 13 can be separated from the crankcase 9, or alternatively, can be integrated with the crankcase 9. The first cylinder body 12 can be separated from the first cylinder head 14, or alternatively, can be integrated with the first cylinder head 14. The second cylinder body 13 can be separated from the second cylinder head 15, or alternatively, can be integrated with the second cylinder head 15.

The first head cover 16 is disposed behind the first cylinder head 14. The first head cover 16 is attached to the first cylinder head 14. The second head cover 17 is disposed behind the second cylinder heal 15. The second heal cover 17 is attached to the second cylinder head 15.

Figure 6:
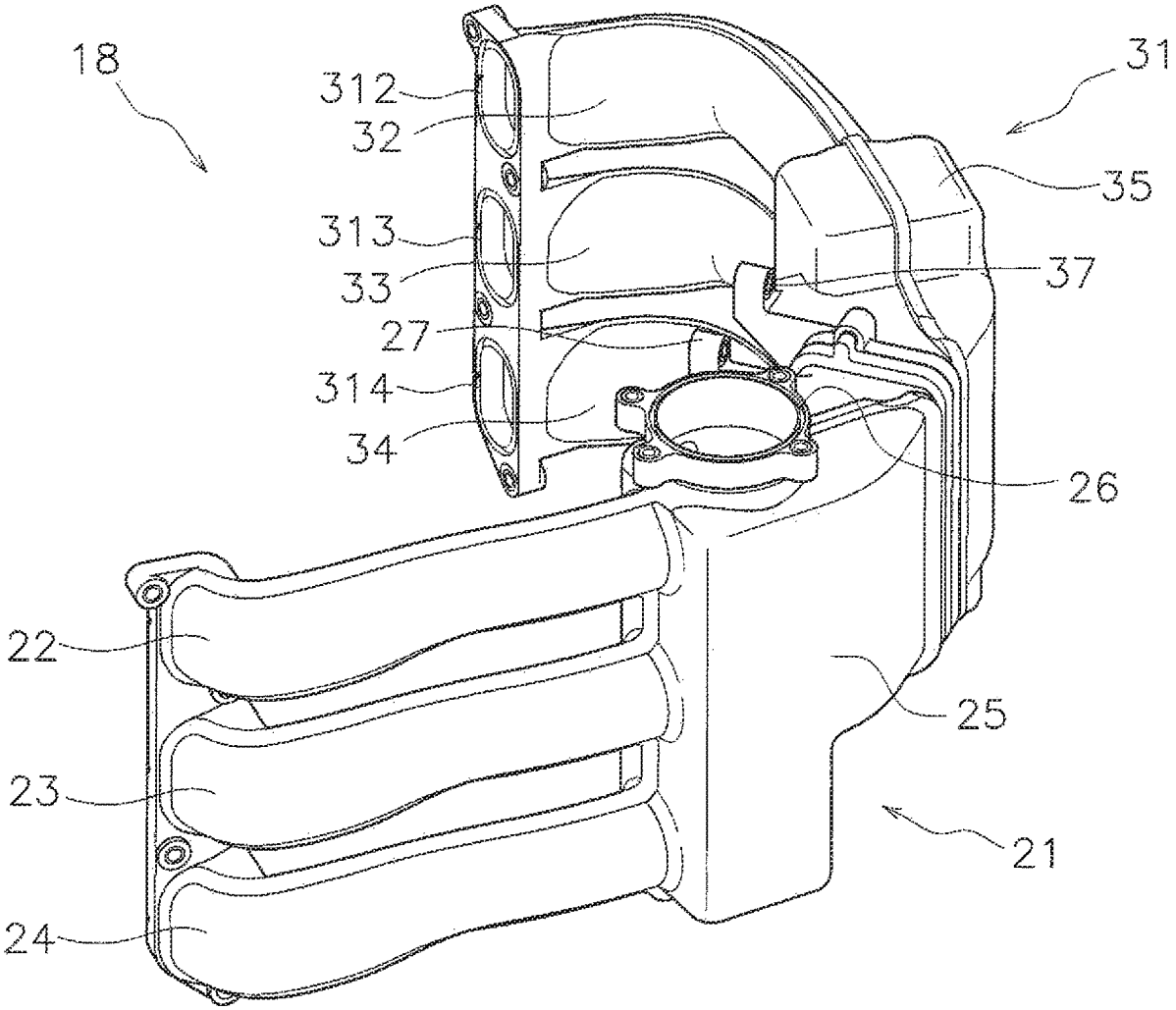
FIG. 6 is a perspective view of an intake pipe for the engine illustrated in FIGS. 2 to 5.

The outboard motor 1 includes an intake pipe 18. FIG. 6 is a perspective view of the intake pipe 18. As shown in FIGS. 2 to 6, the intake pipe 18 is connected to the engine 2. The intake pipe 18 is disposed behind the first and second cylinder heads 14 and 15. The intake pipe 18 includes a first pipe portion 21 and a second pipe portion 31. The first and second pipe portions 21 and 31 are separated from each other.

The first pipe portion 21 is attached to the first cylinder head 14. The first pipe portion 21 is connected to an outer lateral surface 141 of the first cylinder head 14. The outer lateral surface 141 of the first cylinder head 14 is the left lateral surface of the first cylinder head 14. The first pipe portion 21 extends backward from the outer lateral surface 141 of the first cylinder head 14. The first pipe portion 21 is disposed backward of the crankcase 9. The first pipe portion 21 is disposed backward of the first cylinder body 12.

The second pipe portion 31 is attached to the second cylinder head 15. The second pipe portion 31 is connected to an outer lateral surface 151 of the second cylinder heal 15. The outer lateral surface 151 of the second cylinder head 15 is the right lateral surface of the second cylinder head 15. The second pipe portion 31 extends backward from the outer lateral surface 151 of the second cylinder head 15. The second pipe portion 31 is disposed backward of the crankcase 9. The second pipe portion 31 is disposed backward of the second cylinder body 13.

Figure 7:
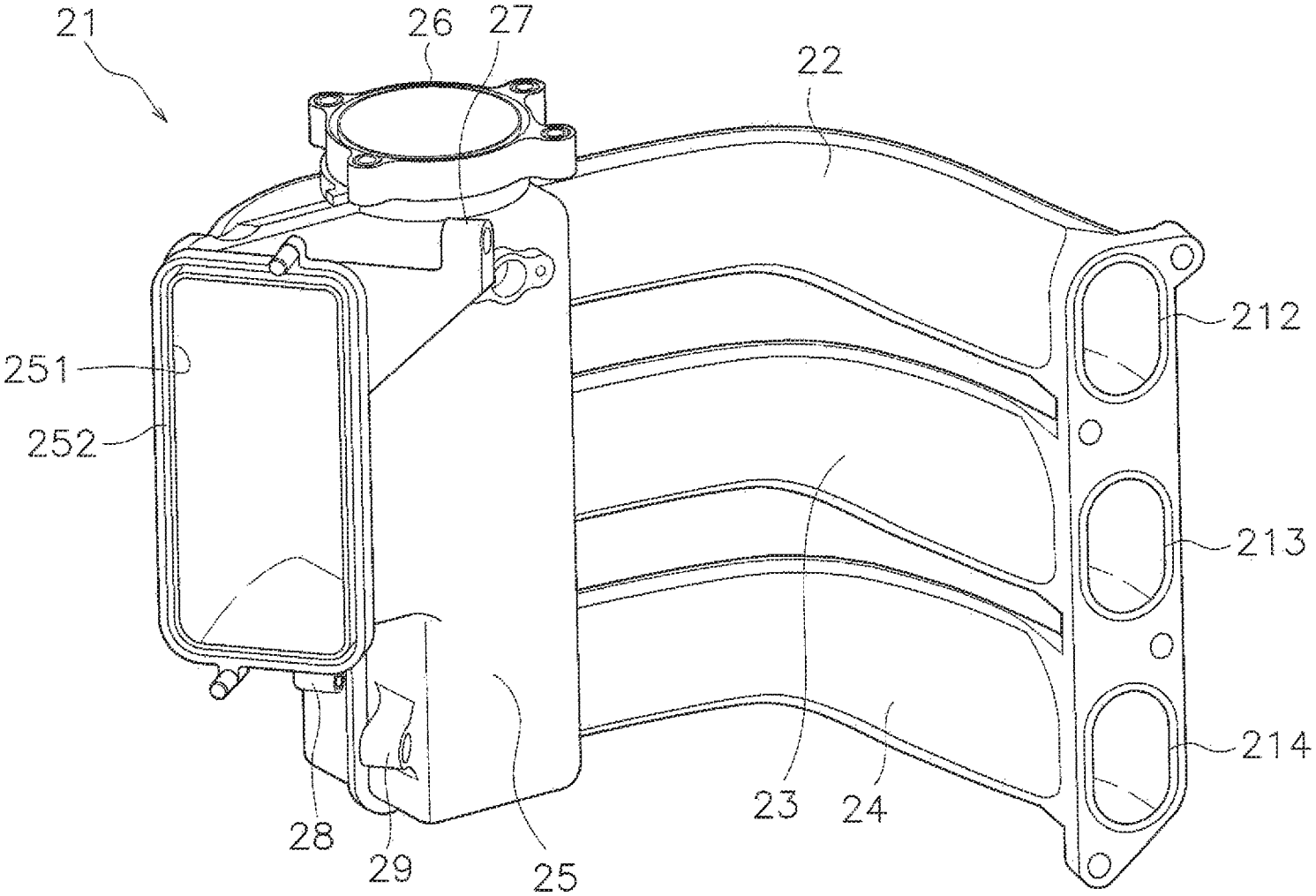
FIG. 7 is a perspective view of a first pipe portion of the intake pipe illustrated in FIG. 6.

FIG. 7 is a perspective view of the first pipe portion 21. As shown in FIG. 7, the first pipe portion 21 includes a plurality of first intake pipes 22 to 24 and a first pipe merge collector 25. The first intake pipes 22 to 24 are disposed in alignment in the up-and-down direction. As shown in FIG. 2, the first intake pipes 22 to 24 are connected to the outer lateral surface 141 of the first cylinder head 14. The first intake pipes 22 to 24 extend backward from the first cylinder head 14. As shown in FIG. 4, the first intake pipes 22 to 24 are shaped to extend through the left side of the first cylinder head 14 and then curve laterally inward in a position behind the first head cover 16.

The first intake pipe 22 includes a first connection port 212. The first intake pipe 23 includes a first connection port 213. The first intake pipe 24 includes a first connection port 214. The first connection ports 212 to 214 are connected to the outer Intend surface 141 of the first cylinder head 14. The first connection ports 212 to 214 are integrated with each other. However, the first connection ports 212 to 214 can be separated from each other.

As seen in the rear view shown in FIG. 5, the first intake pipes 22 to 24 overlap with the first head cover 16. The first intake pipes 22 to 24 are disposed at intervals in the up-and-down direction. As seen in the rear view, ignition coils 41 to 43 are disposed in alternate alignment with the first intake pipes 22 to 24. It should be noted that in the present embodiment, the first pipe portion 21 includes three of the first intake pipes 22 to 24. However, the number of the first intake pipes 22 to 24 is not limited to three, and alternatively, can be less than or greater than three.

The first pipe merge collector 25 is connected to the first intake pipes 22 to 24. The first pipe merge collector 25 extends in the up-and-down direction. The first pipe merge collector 25 is disposed behind the first head cover 16. As seen in the rear view, the first pipe merge collector 25 overlaps with the first head cover 16. The first intake pipes 22 to 24 are connected to the left lateral surface of the first pipe merge collector 25. The first pipe merge collector 25 includes a first connection opening 251. The first connection opening 251 is provided in the right lateral surface of the first pipe merge collector 25. The first pipe merge collector 25 has a polygonal shape. The first connection opening 251 has a polygonal shape. Specifically, the first connection opening 251 has a rectangular shape. However the first connection opening 251 can have a shape other than the rectangular shape. The first pipe merge collector 25 can have a shape other than the polygonal shape.

Figure 8:
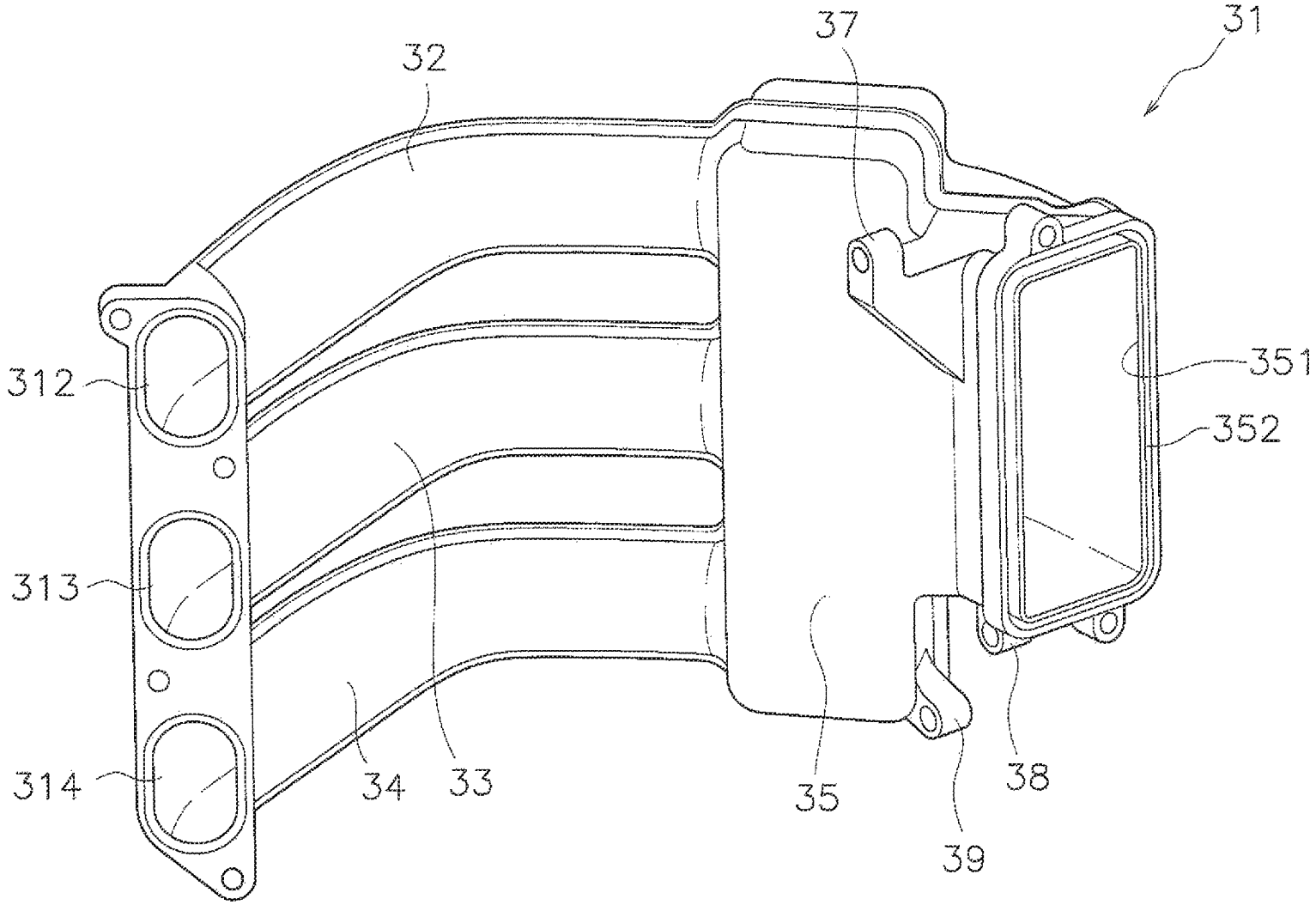
FIG. 8 is a perspective view of a second pipe portion of the intake pipe illustrated in FIG. 6.

FIG. 8 is a perspective view of the second pipe portion 31. As shown in FIG. 8, the second pipe portion 31 includes a plurality of second intake pipes 32 to 34 and a second pipe merge collector 35. The second intake pipes 32 to 34 are disposed in alignment in the up-and-down direction. As shown in FIG. 3, the second intake pipes 32 to 34 are connected to the outer lateral surface 151 of the second cylinder head 15. The second intake pipes 32 to 34 extend backward from the second cylinder head 15. As shown in FIG. 4, the second intake pipes 32 to 34 are shaped to extend through the right side of the second cylinder head 15 and then curve laterally inward in a position behind the second head cover 17.

The second intake pipe 32 includes a second connection port 312. The second intake pipe 33 includes a second connection port 313. The second intake pipe 34 includes a second connection port 314. The second connection ports 312 to 314 are connected to the outer lateral surface 151 of the second cylinder head 15. The second connection ports 312 to 314 are integrated with each other. However, the second connection ports 312 to 314 can be separated from each other.

As seen in the rear view shown in FIG. 5, the second intake pipes 32 to 34 overlap with the second head cover 17. The second intake pipes 32 to 34 are disposed at intervals in the up-and-down direction. As seen in the rear view, ignition coils 44 to 46 are disposed in alternate alignment with the second intake pipes 32 to 34. It should be noted that in the present embodiment, the second pipe portion 31 includes three of the second intake pipes 32 to 34. However, the number of the second intake pipes 32 to 34 is not limited to three, and alternatively; can be less than or greater than three.

The second pipe merge collector 35 is connected to the second intake pipes 32 to 34. The second pipe merge collector 35 extends in the up-and-down direction. The second pipe merge collector 35 is disposed behind the second head cover 17. As seen in the rear view, the second pipe merge collector 35 overlaps with the second head cover 17. The second intake pipes 32 to 34 are connected to the right lateral surface of the second pipe merge collector 35. The second pipe merge collector 35 includes a second connection opening 351. The second connection opening 351 is provided in the left lateral surface of the second pipe merge collector 35. The second pipe merge collector 35 has a polygonal shape. The second connection opening 351 has a polygonal shape. Specifically, the second connection opening 351 has a rectangular shape. However, the second connection opening 351 can have a shape other than the rectangular shape. The second pipe merge collector 35 can have a shape other than the polygonal shape.

The first and second pipe portions 21 and 31 are connected to each other at the first and second connection openings 251 and 351 thereof. The first and second connection openings 251 and 351 are disposed behind the engine 2. In other words, the first and second pipe portions 21 and 31 are coupled to each other in a position behind the engine 2.

Figure 9:
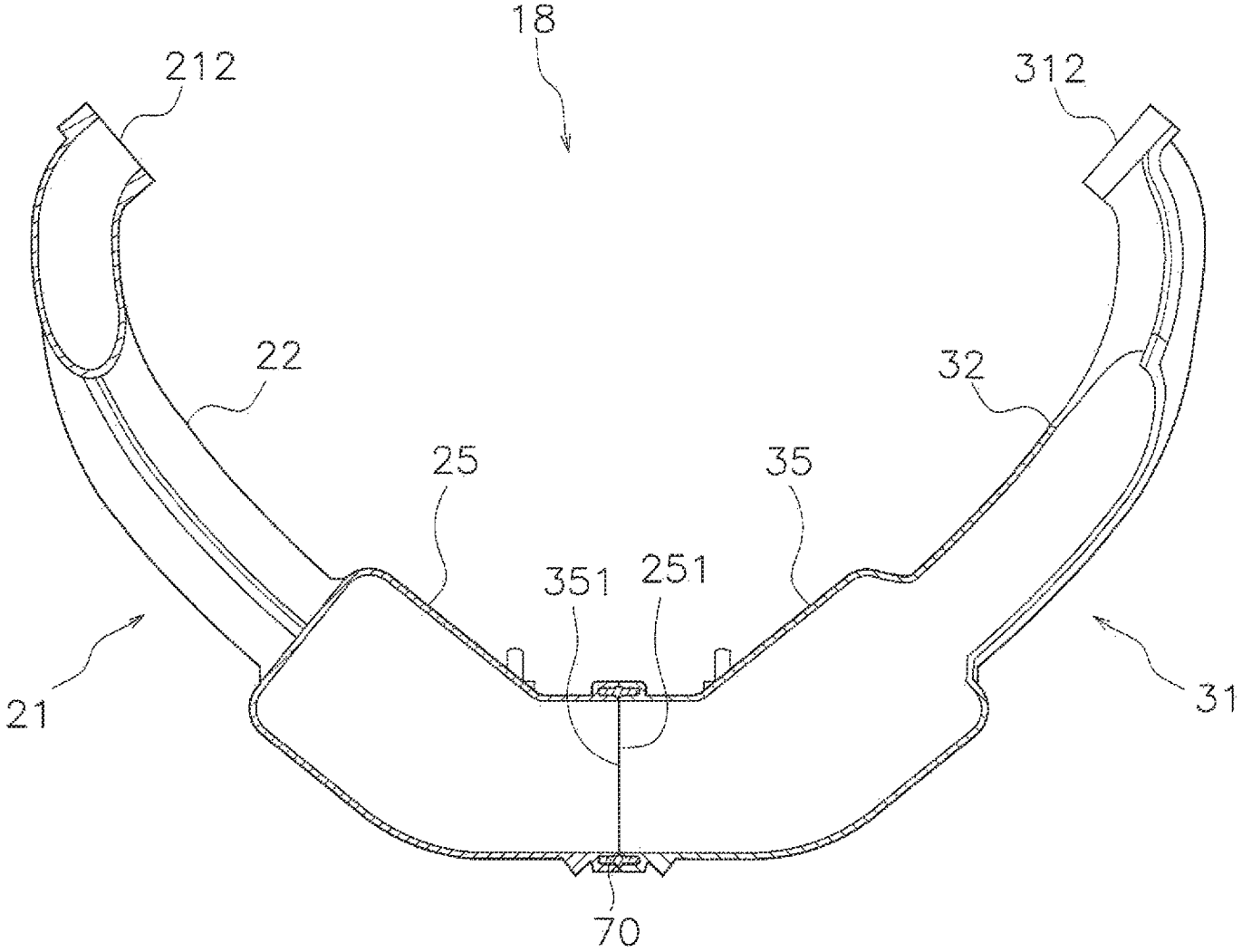
FIG. 9 is a cross-sectional plan view of the intake pipe of the intake pipe illustrated in FIG. 6.

FIG. 9 is a cross-sectional plan view of the intake pipe 18. As shown in FIG. 9, a seal member 70 is provided between the first and second pipe portions 21 and 31. The seal member 70 couples the first and second pipe portions 21 and 31 therethrough, while sealing between the first and second pipe portions 21 and 31. The first and second connection openings 251 and 351 are coupled to each other through the seal member 70 without using any other fastening member such as a bolt.

As shown in FIG. 7, the first pipe portion 21 includes a first groove portion 252 on an end thereof. The first groove portion 252 is provided along the edge of the first connection opening 251. The first groove portion 252 has an annular shape, and also has a polygonal shape similar to that of the first connection opening 251. As shown in FIG. 8, the second pipe portion 31 includes a second groove portion 352 on an end thereof. The second groove portion 352 is provided along the edge of the second connection opening 351. The second groove portion 352 has an annular shape, and also has a polygonal shape similar to that of the second connection opening 351.

The seal member 70 is fitted to both the first groove portion 252 and the second groove portion 352. Similar to the first and second groove portions 252 and 352, the seal member 70 has a rectangular shape. As described above, the first and second connection openings 251 and 351 are disposed behind the engine 2. Therefore, the seal member 70 is disposed behind the engine 2.

Figure 10:
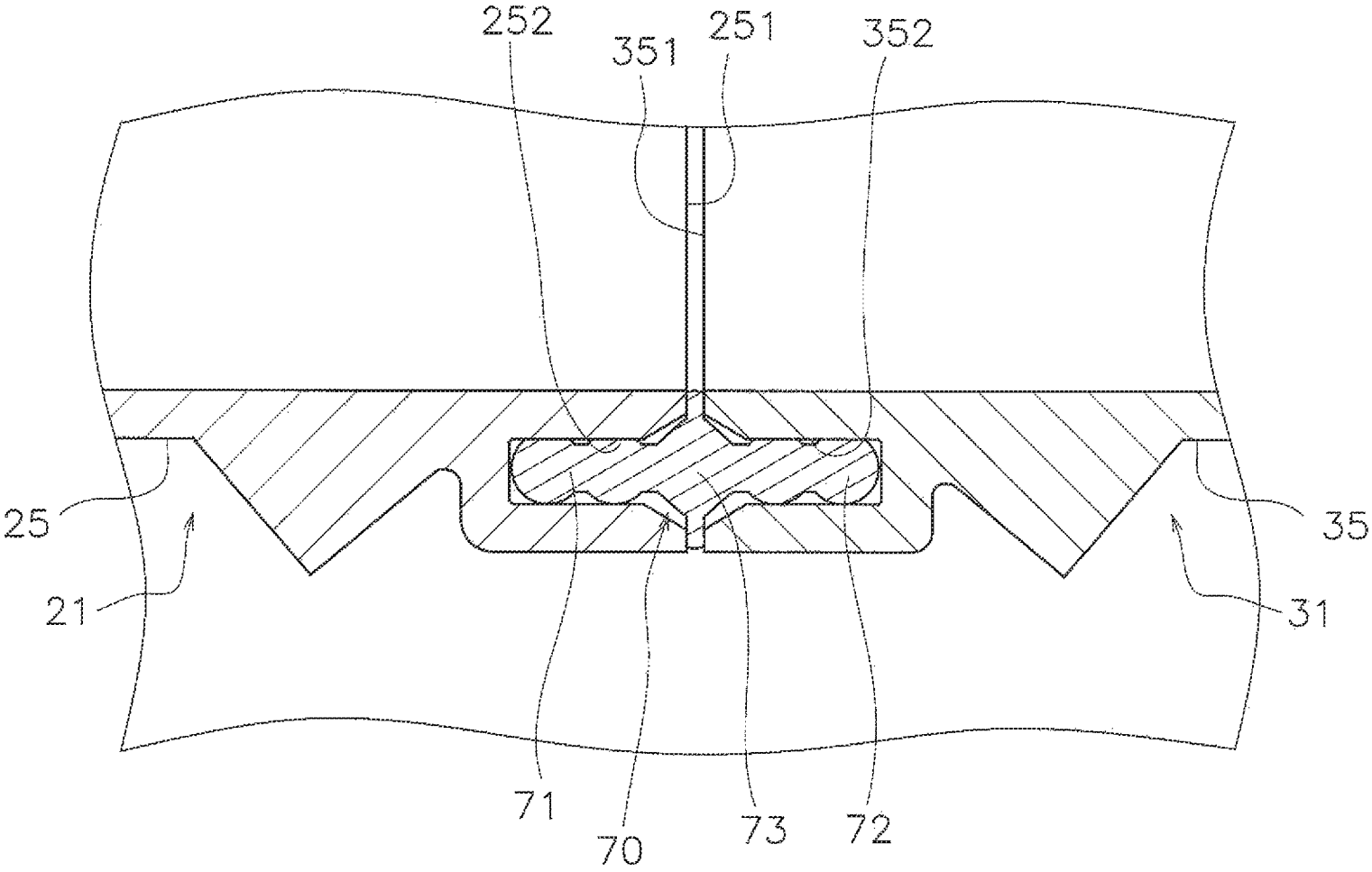
FIG. 10 is an enlarged cross-sectional view of a seal member and the surroundings thereof.

FIG. 10 is an enlarged cross-sectional view of the seal member 70 and the surroundings thereof. As shown in FIG. 10, the seal member 70 includes a first lock portion 71, a second lock portion 72 and a coupling portion 73. The first lock portion 71 is disposed inside the first groove portion 252 and is fitted thereto. The second lock portion 72 is disposed inside the second groove portion 352 and is fitted thereto. The coupling portion 73 couples the first and second lock portions 71 and 72 therethrough. The seal member 70 is made of elastic material such as rubber. Therefore, the first lock portion 71, the second lock portion 72 and the coupling portion 73 are made of elastic material. However, only part of the seal member 70 can be made of elastic material. For example, only the first and second lock portions 71 and 72 can be made of elastic material.

The surface of the first lock portion 71 has a bumpy shape. The first lock portion 71 is press-fitted to the first groove portion 252, and is locked thereto by elasticity thereof. The surface of the second lock portion 72 has a bumpy shape. The second lock portion 72 is press-fitted to the second groove portion 352 and is locked thereto by elasticity thereof.

As shown in FIG. 4, the outboard motor 1 includes a plurality of first exhaust pipes 51, a plurality of second exhaust pipes 52 and a catalytic unit 53. It should be noted that FIG. 4 only shows the uppermost one of the first exhaust pipes 51 and that of the second exhaust pipes 52. The first exhaust pipes 51 and the second exhaust pipes 52 are disposed in the V-shaped space produced between the first and second cylinder heads 14 and 15. The first exhaust pipes 51 are connected to the inner lateral surface of the first cylinder head 14, and extends therefrom backward. The second exhaust pipes 52 are connected to the inner lateral surface of the second cylinder head 15, and extends therefrom backward.

The catalytic unit 53 is a catalytic converter that contains a catalyst such as a three-way catalyst, and purifies exhaust gas transferred thereto from the engine 2. The catalytic unit 53 extends in the up-and-down direction. The catalytic unit 53 is connected to the first exhaust pipes 51 and the second exhaust pipes 52. The catalytic unit 53 is disposed behind the first exhaust pipes 51 and the second exhaust pipes 52. The catalytic unit 53 is disposed in front of the first pipe merge collector 25 of the first pipe portion 21 and the second pipe merge collector 35 of the second pipe portion 31. The catalytic unit 53 is disposed in the V-shaped space produced between the first and second cylinder heads 14 and 15. As seen in the rear view, the catalytic unit 53 overlaps with the first pipe merge collector 25 of the first pipe portion 21 and the second pipe merge collector 35 of the second pipe portion 31. An exhaust pipe 54 is connected to a lower portion of the catalytic unit 53. The exhaust pipe 54 extends downward from the catalytic unit 53.

As shown in FIG. 7, the first pipe portion 21 includes a plurality of first fixation portions 27 to 29. The first pipe portion 21 is fixed at the first fixation portions 27 to 29 to the catalytic unit 53. The first fixation portions 27 to 29 are provided on the first pipe merge collector 25. As shown in FIG. 8, the second pipe portion 31 includes a plurality of second fixation portions 37 to 39. The second pipe portion 31 is fixed at the second fixation portions 37 to 39 to the catalytic unit 53. The second fixation portions 37 to 39 are provided on the second pipe merge collector 35.

The outboard motor 1 includes a throttle body 47. The throttle body 47 is attached to the intake pipe 18. The throttle body 47 is attached to the first pipe portion 21. The throttle body 47 regulates the amount of air to be supplied to the intake pipe 18. As shown in FIG. 6, the first pipe portion 21 includes an attachment portion 26 of the intake pipe 18. The attachment portion 26 is provided on the first pipe merge collector 25 of the first pipe portion 21. Specifically, the attachment portion 26 is provided on the upper surface of the first pipe merge collector 25. The attachment portion 26 is opened upward. The throttle body 47 is attached to the attachment portion 26.

In the outboard motor 1 according to the present embodiment explained above, the intake pipe 18 has the structure that the first and second pipe portions 21 and 31 are coupled to each other through the seal member 70. Because of this, the first and second pipe portions 21 and 31 can be coupled to each other without using a fastening member such as a bolt. Accordingly, it is possible to omit installation of a structure such as a boss through which the fastening member is inserted. Hence, pressure loss can be inhibited in the intake pipe 18.

One embodiment of the present invention has been explained above. However, the present invention is not limited to the aforementioned embodiment, and a variety of changes can be made without departing from the gist of the present invention.

The configuration of the outboard motor 1 is not limited to that of the aforementioned embodiment, and can be changed. The configuration of the engine 2 is not limited to that of the aforementioned embodiment, and can be changed. For example, the engine 2 is not limited to the V engine, and can be another type of engine such as an inline engine.

The layout of the throttle body 47 is not limited to that of the aforementioned embodiment, and can be changed. For example, the throttle body 47 can be attached to the second pipe portion 31. The position, to which the throttle body 47 is attached, is not limited to the upper surface of the intake pipe 18, and can be any other suitable position.

Figure 11:
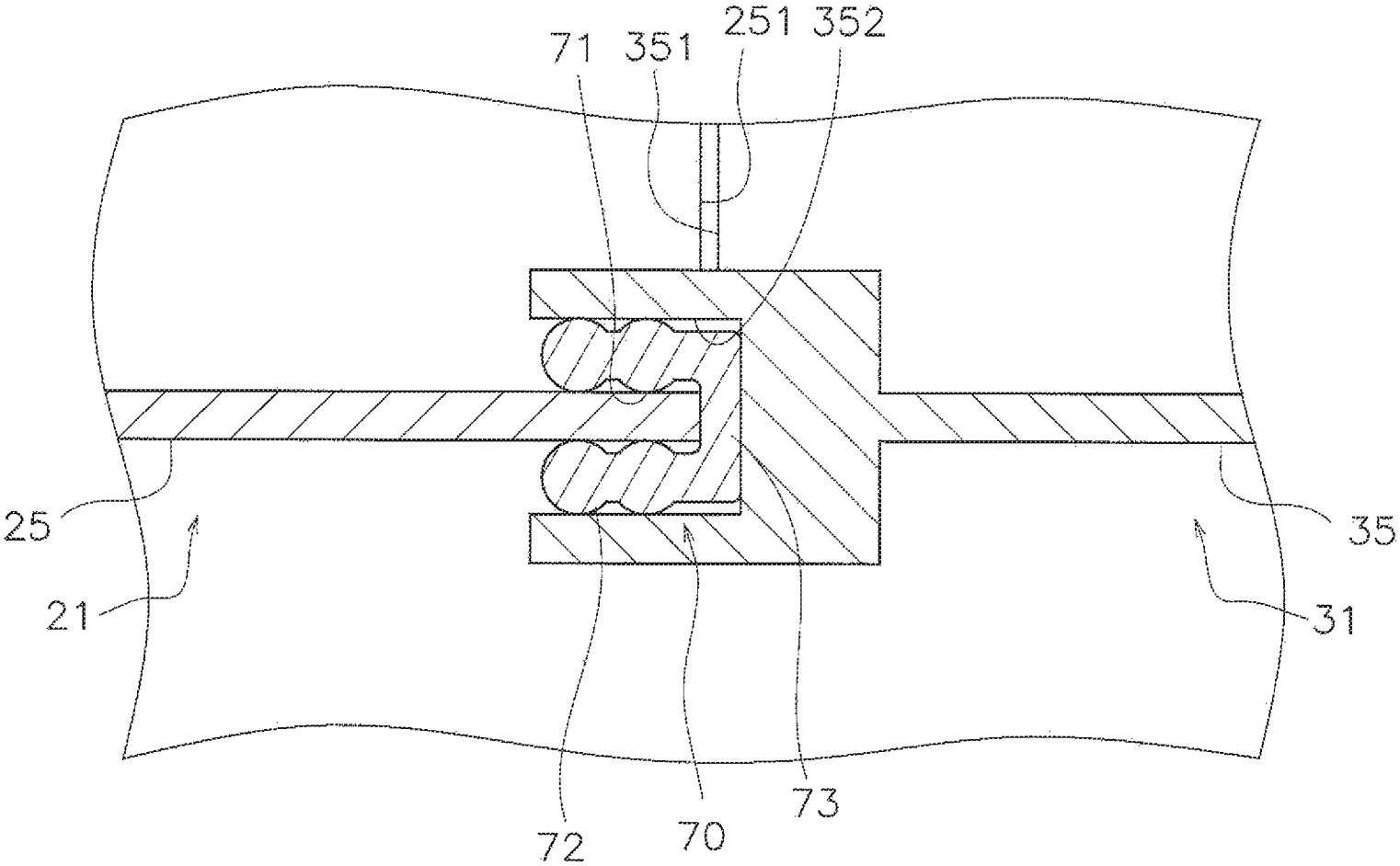
FIG. 11 is an enlarged cross-sectional view of a seal member and the surroundings thereof according to a first modification.

The shape of the seal member 70 is not limited to that of the aforementioned embodiment, and can be changed. For example, FIG. 11 is a cross-sectional diagram showing the seal member 70 according to a first modification. As shown in FIG. 11, the first lock portion 71 can have a groove shape. The first lock portion 71 can be locked to the first pipe portion 21 by fitting the end of the first pipe portion 21 to the first lock portion 71 having the groove shape. The second lock portion 72 can be the outer surface of the seal member 70. The second lock portion 72 can be locked to the second pipe portion 31 by fitting the second lock portion 72 to the second groove portion 352 of the second pipe portion 31. Alternatively, contrarily to the above, the second lock portion 72 can have a groove shape, and the end of the second pipe portion 31 can be fitted to the second lock portion 72 having the groove shape. In this case, the outer surface of the first lock portion 71 can be fitted to the first groove portion 252 of the first pipe portion 21.

Figure 12:
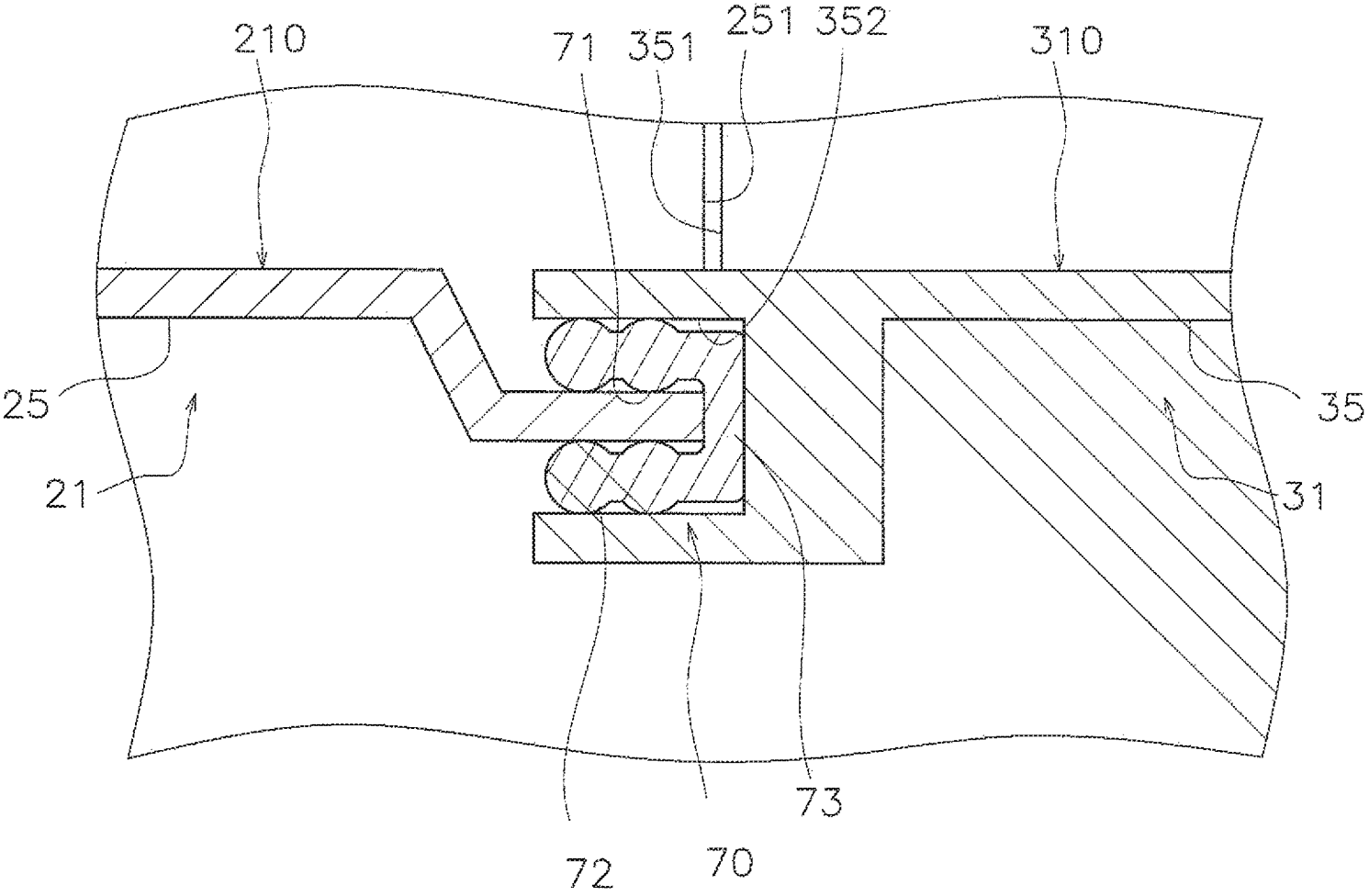
FIG. 12 is an enlarged cross-sectional view of a seal member and the surroundings thereof according to a second modification.

FIG. 12 is a cross-sectional diagram showing the seal member 70 according to a second modification. As shown in FIG. 12, the seal member 70 and the second groove portion 352 can be disposed outside an inner surface 210 of the first pipe portion 21 and an inner surface 310 of the second pipe portion 31. Accordingly, the inner surface 210 of the first pipe portion 21 and the inner surface 310 of the second pipe portion 31 can be approximately flush with each other at the first and second connection openings 251 and 351.

Figure 13:
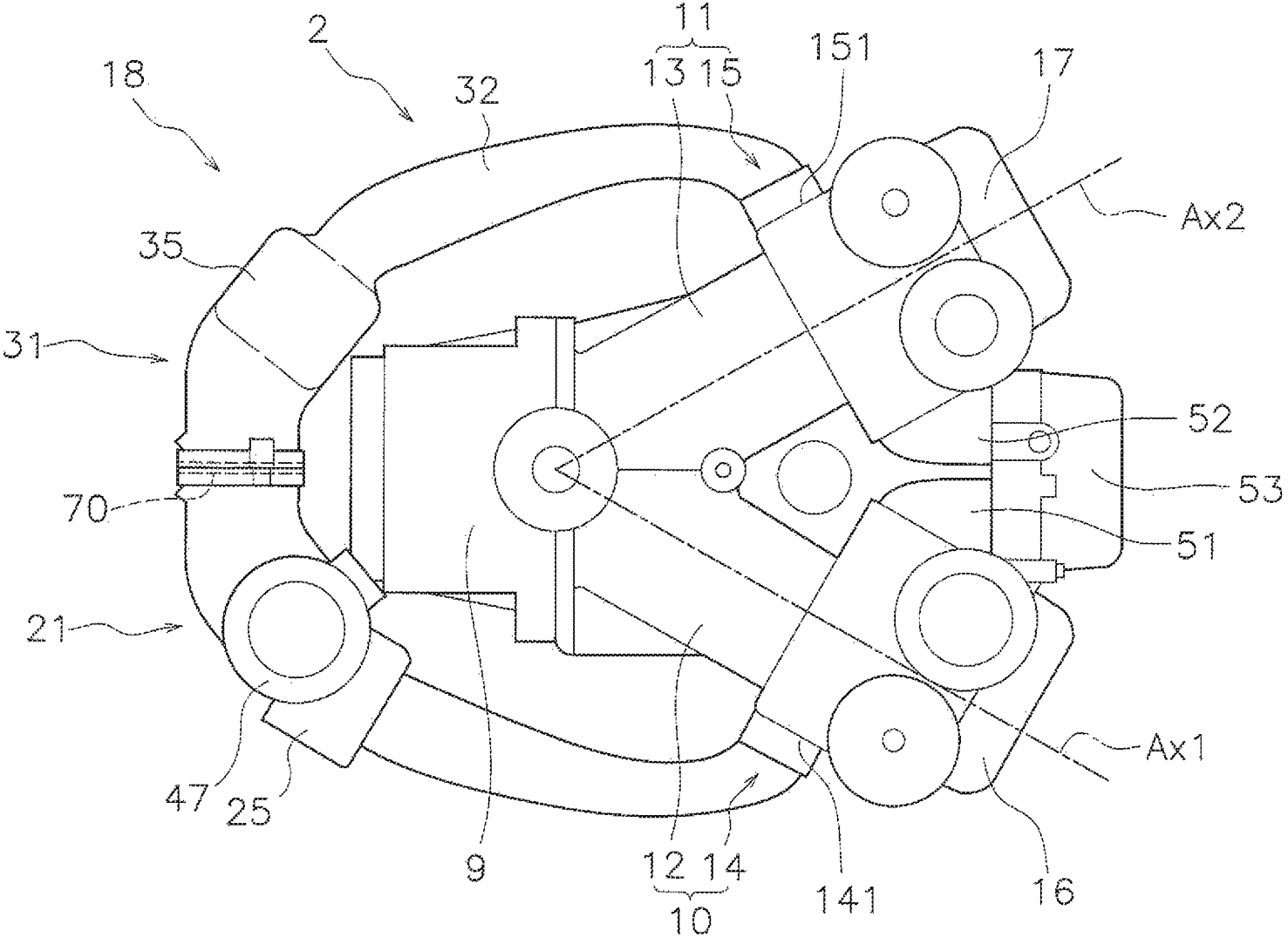
FIG. 13 is a plan view of an engine according to another embodiment.

In the aforementioned embodiment, the first and second pipe portions 21 and 31 are connected to each other behind the engine 2. However, the first and second pipe portions 21 and 31 can be connected to each other in front of the engine 2. For example, FIG. 13 is a plan view of the engine 2 according to another embodiment. As shown in FIG. 13, the first pipe portion 21 can extend forward from the outer lateral surface 141 of the first cylinder head 14. The second pipe portion 31 can extend forward from the outer lateral surface 151 of the second cylinder head 15. The first and second pipe portions 21 and 31 can be coupled to each other in front of the engine 2. In this case, the seal member 70 can be disposed in front of the engine 2.

What is claimed is:

1. An outboard motor comprising:

an engine including a crankshaft;

a driveshaft connected to the crankshaft, the driveshaft extending in an up-and-down direction of the outboard motor;

a propeller shaft connected to the driveshaft, the propeller shaft extending in a front to back direction of the outboard motor;

an intake pipe connected to the engine, the intake pipe including a first pipe portion and a second pipe portion, the first and second pipe portions being provided separately from each other in an axial direction of the intake pipe; and a seal member disposed between the first and second pipe portions, the seal member including first and second lock portions that are secured to the first and second pipe portions at separate locations in the axial direction, respectively, to fasten the first and second pipe portions together such that the seal member prevents separation of the first and second pipe portions in the axial direction, the first and second pipe portions each having an end portion with an inner peripheral wall that defines an end opening and an outer peripheral wall that surrounds the inner peripheral wall and overlaps with the inner peripheral wall as viewed in a radial direction perpendicular to a center axis of the end opening, with the inner peripheral wall and the outer peripheral wall of the first pipe portion forming a first groove portion therebetween, with the inner peripheral wall and the outer peripheral wall of the second pipe portion forming a second groove portion therebetween, with the first and second groove portions receiving the first and second lock portions of the seal member therewithin, respectively.

2. The outboard motor according to claim 1, wherein the first and second pipe portions each have a polygonal shape.

3. The outboard motor according to claim 1, wherein the seal member includes a coupling portion coupling the first and second lock portions therethrough.

4. The outboard motor according to claim 3, wherein the seal member is made of an elastic material at least in the first and second lock portions, the first lock portion is locked to the first pipe portion by elasticity of the first lock portion, and the second lock portion is locked to the second pipe portion by elasticity of the second lock portion.

5. The outboard motor according to claim 1, wherein the engine includes a crankcase in which the crankshaft is at least in part disposed, a first cylinder head connected to the crankcase, and a second cylinder head connected to the crankcase, the first pipe portion is connected to the first cylinder head, and the second pipe portion is connected to the second cylinder head.

6. The outboard motor according to claim 5, wherein the first and second cylinder heads are disposed on a back side of the crankcase with respect to the front to back direction of the outboard motor, the first and second cylinder heads being disposed in alignment in a right-and-left direction of the outboard motor, the first pipe portion is connected to an outer lateral surface of the first cylinder head, and the second pipe portion is connected to an outer lateral surface of the second cylinder head.

7. The outboard motor according to claim 6, wherein the first pipe portion extends backward of the outer lateral surface of the first cylinder head from the outer lateral surface of the first cylinder head with respect to the front to back direction of the outboard motor, the second pipe portion extends backward of the outer lateral surface of the second cylinder head from the outer lateral surface of the second cylinder head with respect to the front to back direction of the outboard motor, the first and second pipe portions are coupled to each other on a back side of the engine with respect to the front to back direction of the outboard motor, and the seal member is disposed on the back side of the engine with respect to the front to back direction of the outboard motor.

8. The outboard motor according to claim 6, wherein the first pipe portion extends forward of the outer lateral surface of the first cylinder head from the outer lateral surface of the first cylinder head with respect to the front to back direction of the outboard motor, the second pipe portion extends forward of the outer lateral surface of the second cylinder head from the outer lateral surface of the second cylinder head with respect to the front to back direction of the outboard motor, the first and second pipe portions are coupled to each other on a front side of the engine with respect to the front to back direction of the outboard motor, and the seal member is disposed on the front side of the engine with respect to the front to back direction of the outboard motor.

9. The outboard motor according to claim 1, wherein the first pipe portion is integrally formed as a one-piece, unitary member, and the second pipe portion is integrally formed as a one-piece, unitary member.

10. An outboard motor comprising:

an engine including a crankshaft;

a driveshaft connected to the crankshaft, the driveshaft extending in an up-and-down direction of the outboard motor;

a propeller shaft connected to the driveshaft, the propeller shaft extending in a front to back direction of the outboard motor;

an intake pipe connected to the engine, the intake pipe including a first pipe portion and a second pipe portion, the first and second pipe portions being provided separately from each other, one of the first and second pipe portions having an end portion with an inner peripheral wall that defines an end opening and an outer peripheral wall that surrounds the inner peripheral wall and overlaps with the inner peripheral wall as viewed in a radial direction perpendicular to a center axis of the end opening, the other one of the first and second pipe portions having an end portion that is disposed between the inner peripheral wall and the outer peripheral wall of the one of the first and second pipe portions in the radial direction to form an inner groove portion between the inner peripheral wall of the one of the first and second pipe portions and the end portion of the other one of the first and second pipe portions and an outer groove portion between the end portion of the other one of the first and second pipe portions and the outer peripheral wall of the one of the first and second pipe portions; and a seal member disposed between the first and second pipe portions, the seal member including inner and outer lock portions that are secured to the inner and outer groove portions, respectively, to fasten the first and second pipe portions together such that the seal member prevents separation of the first and second pipe portions in an axial direction along the center axis of the end opening.

11. The outboard motor according to claim 1, wherein the seal member is integrally formed as a one-piece, unitary member.

12. An outboard motor comprising:

an engine including a crankshaft;

a driveshaft connected to the crankshaft, the driveshaft extending in an up-and-down direction of the outboard motor;

a propeller shaft connected to the driveshaft, the propeller shaft extending in a front to back direction of the outboard motor;

an intake pipe connected to the engine, the intake pipe including a first pipe portion and a second pipe portion, the first and second pipe portions being provided separately from each other; and a seal member disposed between the first and second pipe portions, the seal member being secured to the first and second pipe portions to fasten the first and second pipe portions together such that the seal member prevents separation of the first and second pipe portions in an axial direction of the intake pipe, the seal member including a first lock portion, a second lock portion, and a coupling portion that couples the first and second lock portions therethrough, the first lock portion, the second lock portion and the coupling portion being made of an elastic material and integrally formed as a one-piece, unitary member, the first lock portion being locked to the first pipe portion by elasticity of the first lock portion, and the second lock portion being locked to the second pipe portion by elasticity of the second lock portion.

13. The outboard motor according to claim 12, wherein the first lock portion and the second lock portion extends from end portions of the coupling portion in opposite directions relative to the coupling portion such that the seal member has a linear shape.

14. The outboard motor according to claim 12, wherein the first lock portion and the second lock portion extends from end portions of the coupling portion in a same direction relative to the coupling portion such that the seal member has a bent shape.

15. The outboard motor according to claim 1, wherein the first and second pipe portions are secured without a bolt.

16. The outboard motor according to claim 1, wherein the first and second pipe portions are solely secured by the seal member.

17. The outboard motor according to claim 10, wherein the first and second pipe portions are secured without a bolt.

18. The outboard motor according to claim 10, wherein the first and second pipe portions are solely secured by the seal member.

19. The outboard motor according to claim 12, wherein the first and second pipe portions are secured without a bolt.

20. The outboard motor according to claim 12, wherein the first and second pipe portions are solely secured by the seal member.

* * * * *